US006601716B1

(12) United States Patent
Hayman et al.

(10) Patent No.: US 6,601,716 B1
(45) Date of Patent: Aug. 5, 2003

(54) STACKABLE AND ROLLABLE RACK

(75) Inventors: Yates Westley Hayman, Walker, LA (US); Robert Lea, Watson, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 0 days.

(21) Appl. No.: 10/090,590

(22) Filed: Feb. 28, 2002

(51) Int. Cl.[7] ..... A47B 43/00
(52) U.S. Cl. ..... 211/194
(58) Field of Search ..... 280/79.3; 211/194, 211/195, 189; 182/178.1, 178.5

(56) References Cited

U.S. PATENT DOCUMENTS 2,699,911 A * 1/1955 Chase et al.
3,837,427 A * 9/1974 Mattinson
4,199,069 A * 4/1980 Talarico ..... 211/189 X
5,233,931 A * 8/1993 McCorkle
5,238,126 A * 8/1993 Rindoks ..... 211/194 X
5,370,245 A * 12/1994 Tersch et al. ..... 211/194 X
5,609,451 A * 3/1997 McCorkle ..... 211/194 X
5,647,284 A * 7/1997 Frysinger et al.
5,692,625 A * 12/1997 Filipescu et al. ..... 211/194 X
6,135,299 A * 10/2000 Burgess ..... 211/194

* cited by examiner

*Primary Examiner*—Robert W. Gibson, Jr.
(74) *Attorney, Agent, or Firm*—Jones, Walker, Waechter, Poitevent, Carrere & Denegre, L.L.P.

(57) ABSTRACT

A stackable rack having a frame of vertical members and horizontal members, where each vertical member terminates in a foot portion at one end and a top engagement portion at the other end. The foot portion has a flange for accepting a wheel, and an upward tapering sleeve portion surrounded by the flange, the upward tapered section creating an engagement pocket. The top engagement portion of a vertical member is shaped to be insertable and engagable with the engagement pocket, to allow the top engagement end of one rack to be inserted into the engagement pocket of another rack for stacking racks.

4 Claims, 4 Drawing Sheets

ELEVATION VIEW

ELEVATION VIEW

Figure 3C (VIEW "A"-"A")

ELEVATION VIEW

PLAN VIEW

ELEVATION VIEW

STACKABLE AND ROLLABLE RACK

FIELD OF THE INVENTION

This invention relates to stackable racks, and in particular, to stackable rollable racks with detachable wheels.

BACKGROUND OF THE INVENTION

In scaffolding, unassembled scaffold parts need to be moved from location to location, either for transportation to the job site, or movement about the job site. When not in use, scaffold parts are stored. Prior devices for storage of scaffold structured consisted of a square or rectangular frame bottom, having beams or pipes extending upwardly at each corner of the frame to create a box-like frame within which scaffold pieces are stacked. This box frame may have casters attached for rolling the structure about. The box frames help organize the scaffold parts when the parts are not in use, and help assist in transportation of the dis-assembled scaffold parts. The box-frames, however are bulky devices, and take up much needed space at the storage site or job site, when empty or when used for storage. It is desirable to be able to stack these devices to reduce the storage space requirements, where the stacking created a stable structure. Other box frames have been designed for removable casters, such as having the caster flange insertable into a flange pocket on the ends of a vertical frame member, but these frames were not matingly stackable.

OBJECTS OF THE INVENTION

It is an object of the invention to provide a stackable rack structure.

It is another object of the invention to provide a stackable rack structure adapted for use with detachable wheels.

SUMMARY OF THE INVENTION

The invention is a frame with frusto-shaped feet creating a flange. The feet are hollow, and attached to the feet are upwardly extending side pieces. The top of each side piece is matching frusto-shaped, allowing the side piece to be inserted into the hollow feet of another rack enabling the racks to be stacked atop each other.

BRIEF DESCRIPTION OF THE DRAWINGS

FIG. 3C is a top view of a rack vertical support member.

DETAILED DESCRIPTION OF THE INVENTION

Figure 3A:
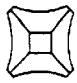
FIG. 3A is a side view of a stackable rack.
Figure 3A:
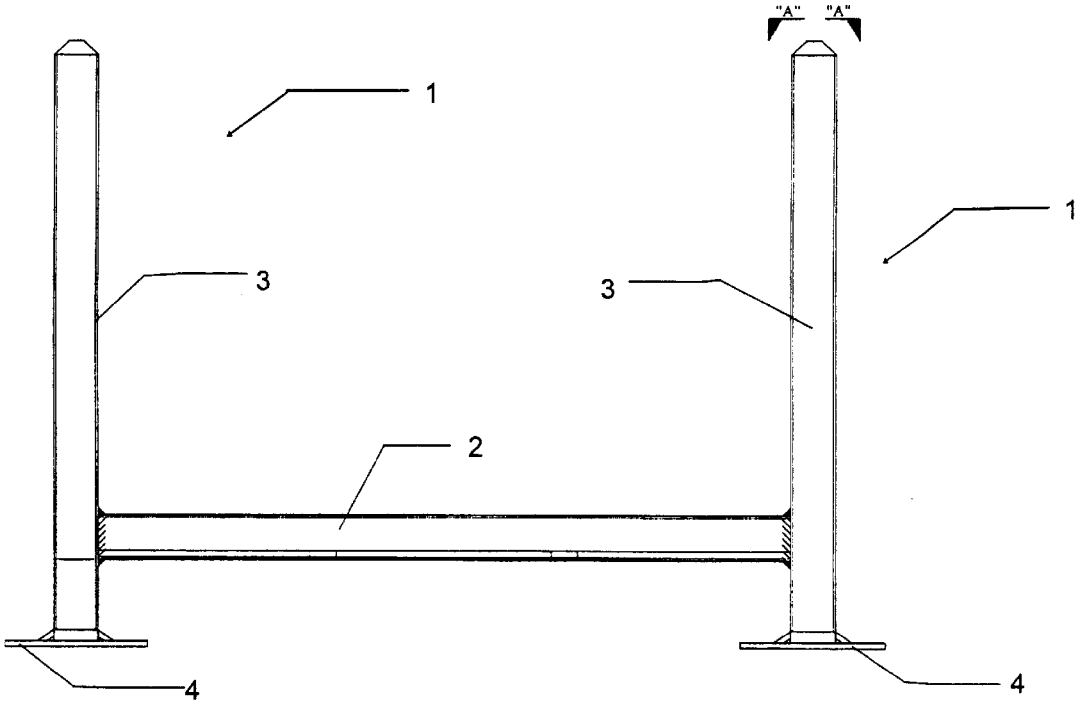
Figure 3B:
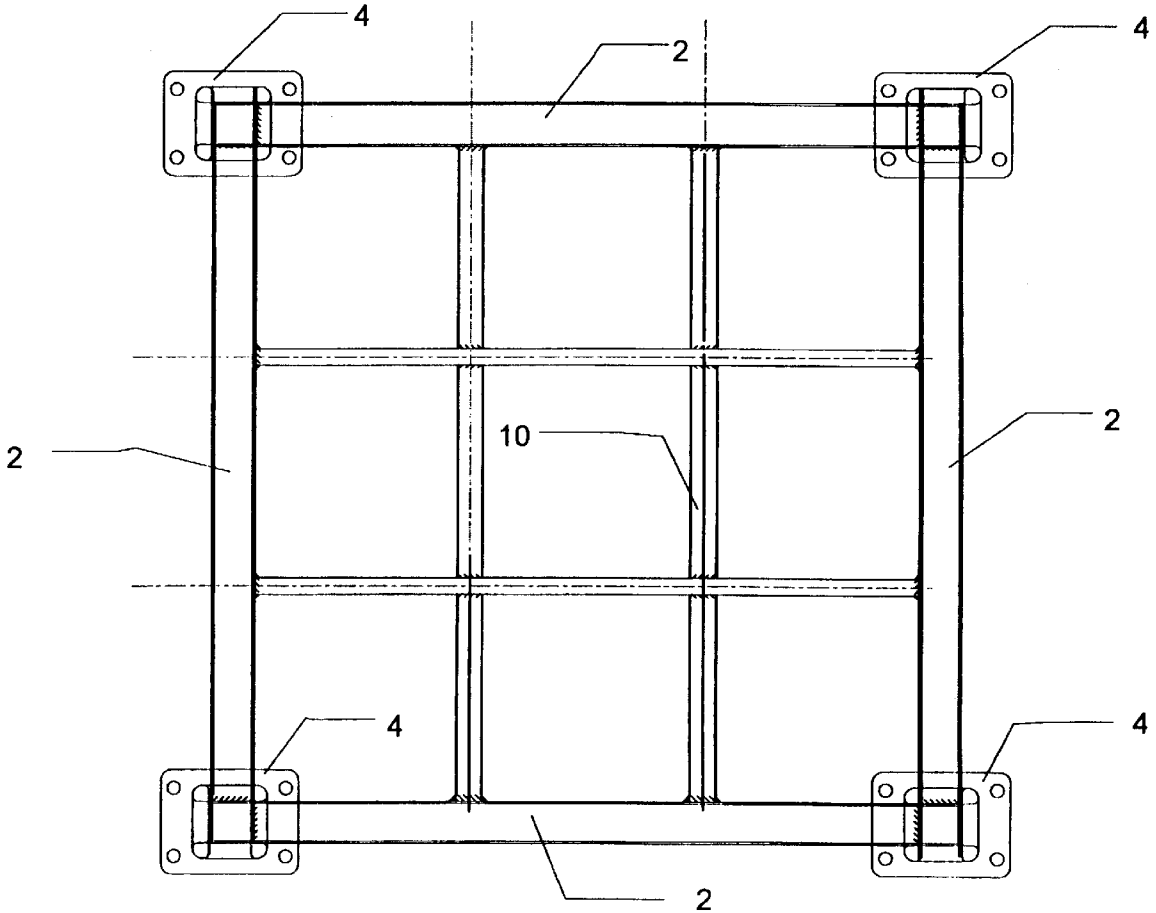
FIG. 3B is a top view of a stackable rack.

The invention is stackable rack adapted for use with wheels or casters. Shown in FIG. 3A is a side view of one such stackable rack. Shown in frame 1, consisting of horizontal support members 2 and vertical support members 3. Horizontal support members 2 and vertical support members 3 create a hollow open-sided box like structure, the frame 1. Note, this particular geometry (rectangular or square bottom) is not necessary—the base could be oval, round triangular or any arbitrary shape. As shown in FIG. 3A, the frame has a single horizontal platform formed from the horizontal members. Obviously, additional platforms could be included.

As shown, the vertical and horizontal members are constructed of 2.5×2.5 inch square steel tubing. Interior to the horizontal members 2 is a grid 10 of horizontal crossbars. These cross bars, as shown, are 1×2 inch square tubing, with the top of some of the grid bars aligned with the top of the horizontal members, creating a support surface or platform. Certain of the grid's cross bars 10 may be aligned with the bottom of the horizontal support members 2, to assist loading of a rack by forklift, by providing horizontal support surfaces for engagement with the forks of a forklift.

Figure 1:
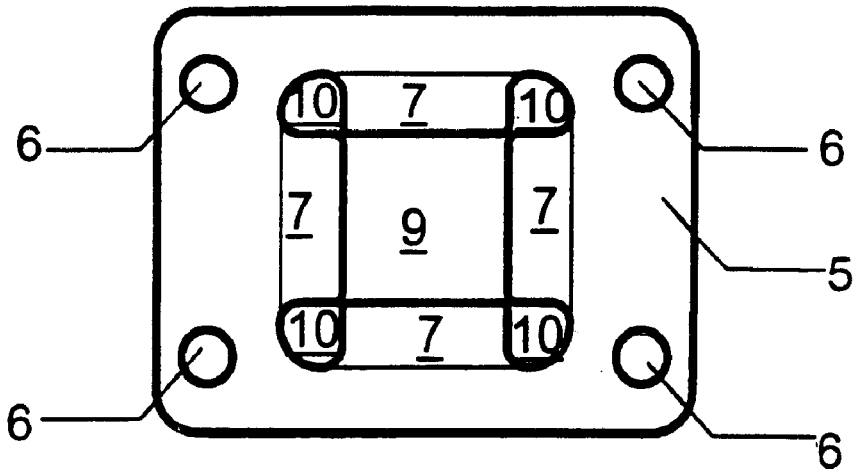
FIG. 1 depicts a top view of one embodiment of a frame foot.
Figure 2:
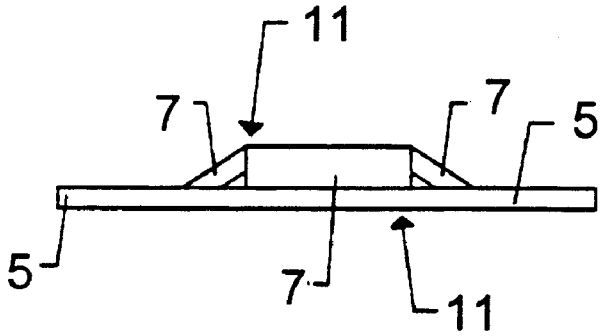
FIG. 2 is a side view of the foot shown in FIG. 1.

At the base of each vertical support member (or side piece) is a foot 4. A detail of the foot geometry is shown in FIGS. 1 and 2. As shown, foot 4 has a flange surface 5, with holes 6 therethrough. The flange surface creates a flat surface upon which to attach a caster or wheeled body (shown in FIG. 4). Holes 6 are one means to attach the caster, for instance, with bolts.

As shown, flange is rectangular shaped. The center of the flange 9 opens into the interior of the vertical support member to which the foot 4 is attached. The walls of the flange 7 surrounding. the center opening 9 are bent upwardly, creating an upwardly shaped frusto-shaped sleeve. In this case, the sleeve is frusto-square-pyramidal shaped. The frusto-shaped walls result in a tapered sleeve, to which the vertical support member 3 extends from. The tapered sleeve portion creates an engagement pocket 11. As shown, center-opening 9 is surrounded by four smaller openings 10, positioned in the "corners" of the square center opening. These openings 10 are punched in the flat flange plate in conjunction with punching the center opening 9 and bending of the foot interior walls into a frusto or a tapering upwards shaped sleeve 11. Connected to the top of this sleeve 11 will be the vertical member 3.

Figure 4:
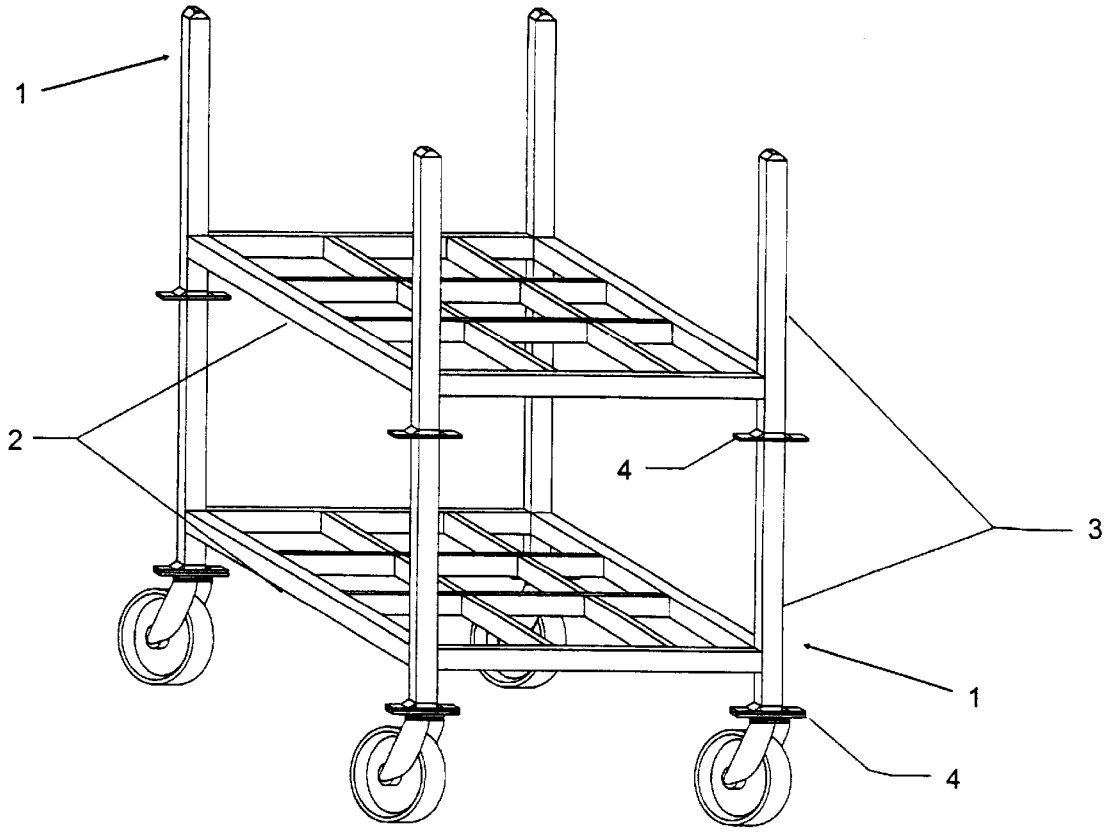
FIG. 4 is a side view showing two racks stacked atop each other.

The other end of the vertical support member (the top end) has an engagement surface designed to engage and supportingly mate with the engagement pocket created by the tapered sleeve section of a foot. When the foot's tapered sleeve is frusto-square-pyramidal shaped, the top of the vertical support member will be a similarly shaped frusto—square pyramidal shape, as is shown in FIG. 3*c*. This top vertical member geometry allows the top of the vertical member to be "inserted" into the foot's hollow tapered sleeve. Or engagement pocket. It is preferred that the two surfaces ((a) interior of foot sleeve and (b) top surface of vertical member) be correspondingly and matingly shaped to provide maximum support; however, it is not necessary that the two surfaces be identically shaped. Consequently, the geometry of the top vertical support members and the tapered foot allows the stacking of racks, as is shown in FIG. 4. The tapering sides of the foot sleeve and the tapered top of the vertical support member assists in vertical alignment of racks for stacking and substantial contact and support between an inserted top vertical member in a first frame with the interior of the tapered foot in the second member. The inter meshing of the top of a vertical member and foot thus allows for stacking of frame member, one atop another, foot to top vertical member. To assist in contact, and support, the top of each vertical member could also include a flange, positioned below the top taper, which flange would contact the foot's flange of a stacked rack. Obviously, the frusto-pyramidal shape could be replace with other tapering shapes, such as a frusto-cone-shape, or frusto-triangular-pyramidal shape. The mating of the engagement pocket with the engagement portion results in a stable structure when one rack is stacked upon another, that is, the top rack cannot be pushed off the lower rack, but must be lifted up to clear the engagement, before the top rack can be removed.

To stack two racks, the top rack would be picked up (such as via forklift) and any wheels would be removed. The top rack would then be aligned over the bottom tack so that verticals members of the top rack are aligned with the vertical members of the second bottom rack. The top rack would then be lowered, and the bottom engagement portions of the vertical members would be inserted into the engagement pockets of the top rack, aligning and supporting a set of two stacked racks. Obviously, multiple racks can be stacked.

Although certain preferred embodiments have been described above, it will be appreciated by those skilled in the art to which the present invention pertains that modifications, changes, and improvements may be made without departing from the spirit of the invention defined by the claims. All such modifications, changes, and improvements are intended to come within the scope of the present invention.

We claim:

1. A stackable rack comprising a plurality of vertical members and horizontal members connected to form a frame having open sides, at least two of said vertical members terminating in a foot portion, each of said foot portions having a (1) flange adapted to removeably accept a wheel, and (2) an upward tapering sleeve portion surrounded by said flange creating an engagement pocket; said frame further having at least two of said plurality of vertical members terminating in a tapered head at an end distal from said foot portion, said tapered head adapted to be insertable into said engagement pocket of a second stackable rack.

2. A rack according to claim 1 where said tapered section is a frusto-shaped.

3. A rack according to claim 1 where said tapered section is frusto-pyramidal shaped and having an opening in said flange positioned at each corner of the frusto-pyramidal shaped tapered section.

4. A rack according to claim 1 where said horizontal members define at least one platform.

* * * * *